United States Patent [19]

Davis, Jr. et al.

[11] Patent Number: 4,832,007

[45] Date of Patent: May 23, 1989

[54] TRACTION PILLOW AND METHOD

[75] Inventors: Leonard L. Davis, Jr., St. Louis, Mo.; Daniel J. Schafer, Greenville, S.C.

[73] Assignee: Span-America Medical Systems, Inc., Greenville, S.C.

[21] Appl. No.: 180,371

[22] Filed: Apr. 12, 1988

[51] Int. Cl.[4] ..... A47C 20/00

[52] U.S. Cl. ..... 128/70; 128/69; 5/434; 5/436; 5/442

[58] Field of Search ..... 128/70, 69; 5/434, 436, 5/442

[56] References Cited

U.S. PATENT DOCUMENTS

| | | | |
|---|---|---|---|
| D. 276,938 | 12/1984 | Pedersen | D24/36 |
| 1,312,886 | 8/1919 | Bawden . | |
| 2,305,173 | 12/1942 | Leeb | 5/345 |
| 2,674,752 | 4/1954 | Berman | 5/337 |
| 2,700,779 | 2/1955 | Tolkowsky | 128/70 |
| 2,880,428 | 4/1959 | Forsland | 5/337 |
| 3,047,282 | 7/1962 | Hardy | 267/1 |
| 3,239,854 | 3/1966 | Freedlander | 5/337 |
| 3,319,272 | 5/1967 | Eller | 5/338 |
| 3,400,413 | 9/1968 | Grossa | 5/338 |
| 3,434,715 | 3/1969 | Brantingham et al. | 272/57 |
| 3,521,310 | 7/1970 | Greenawalt | 5/337 |
| 3,529,306 | 9/1970 | Thorne | 2/3 |
| 3,602,928 | 9/1971 | Helzer | 5/338 |
| 3,753,264 | 8/1973 | Grenier | 5/338 |
| 3,829,917 | 8/1974 | De Laittre et al. | 5/338 |
| 3,842,453 | 10/1974 | Redfield | 5/434 |
| 3,851,347 | 12/1974 | Ashley | 5/338 |
| 3,885,257 | 5/1975 | Rogers | 5/345 |
| 3,974,532 | 8/1976 | Ecchuya | 5/345 |
| 4,070,719 | 1/1978 | Morgan | 5/355 |
| 4,110,881 | 9/1978 | Thompson | 29/91.1 |
| 4,114,612 | 9/1978 | Benjamin | 128/69 |
| 4,147,825 | 4/1979 | Talalay | 418/138 |
| 4,207,636 | 6/1980 | Ceriani | 5/481 |
| 4,218,792 | 8/1980 | Kogan | 5/436 |
| 4,320,543 | 3/1982 | Dixon | 5/434 |
| 4,383,342 | 5/1983 | Forster | 5/432 |
| 4,399,574 | 8/1983 | Shuman | 5/417 |
| 4,424,599 | 1/1984 | Hannouche | 5/436 |
| 4,483,329 | 11/1984 | Shamos | 128/69 |
| 4,494,261 | 1/1985 | Morrow | 5/434 |
| 4,524,473 | 6/1985 | Fanti | 5/481 |
| 4,550,459 | 11/1985 | Endel et al. | 5/436 |
| 4,573,456 | 3/1986 | Spann | 128/80 R |
| 4,603,445 | 8/1986 | Spann | 5/481 |
| 4,620,337 | 11/1986 | Williams et al. | 5/464 |
| 4,760,842 | 8/1988 | Holmes | 128/69 |

FOREIGN PATENT DOCUMENTS

| | | | |
|---|---|---|---|
| 569690 | 10/1958 | Belgium . | |
| 1554105 | 11/1969 | Fed. Rep. of Germany . | |
| 2253330 | 5/1974 | Fed. Rep. of Germany | 5/436 |
| 1099929 | 9/1955 | France . | |
| 1120734 | 6/1956 | France . | |
| 2504795 | 11/1982 | France . | |
| 526407 | 5/1955 | Italy . | |
| 2527 | of 1911 | United Kingdom | 5/436 |
| 2084867 | 4/1982 | United Kingdom . | |

OTHER PUBLICATIONS

Advertisements for the ProPillow by ProTechPacific, 900 Larkspur Landing Circle, Suite 105, Larkspur, CA 94939 (undated).

*Primary Examiner*—Edgar S. Burr
*Assistant Examiner*—Kimberly L. Asher
*Attorney, Agent, or Firm*—Dority & Manning

[57] ABSTRACT

A pillow of resilient material has a generally rotatable portion (cervical roll) for supporting the cervical region of a user. With a user's neck received across the pillow cervical roll and the user's head received on the pillow, rotation of the cervical roll in conjunction with collapse of angled chambers defined within the resilient pillow establishes traction in the cervical region of the user. Once its internal chambers are essentially fully collapsed, the pillow provides a generally continuous support medium for optimized resilient support of the user's neck and head, while maintaining a degree of cervical region traction with natural cervical curvature achieved through curved support of the user's cervical region across the cervical roll of the pillow.

18 Claims, 4 Drawing Sheets

TRACTION PILLOW AND METHOD

BACKGROUND OF THE INVENTION

This invention generally concerns a pillow preferably comprised of resilient material, and a method of use for same, and more particularly concerns a pillow for inducing an amount of traction in a user, and a related method of establishing such traction.

The neck or cervical region of a person has a natural, i.e. normal, curvature, which is generally concave towards the back of the person. Conventional traction techniques, such as may be used with patients in a hospital setting or others undergoing treatment, involves immobilization of a selected limb or region of a patient, usually by application of a continuous stretching force to the selected limb or region (sometimes involving the entire body). Whenever such traction involves the cervical (i.e. neck) region of a patient, the natural or normal curvature of such region is often lost or distorted to a certain degree. In other words, the neck region tends to be flattened out. Application of any degree of loading (i.e. traction) to the cervical region while it is in a position other than its normal curvature can in the best case be uncomfortable for the patient, and in the worst case actually cause or aggravate injuries in the cervical region.

Use of traction for a patient can be indicated for a variety of reasons. One typical scenario in which traction might be applied is whenever a patient experiences muscle spasms in the back or neck. The spasms might be treated with various amounts of therapeutic traction, drug therapies, and/or various combinations of both such therapies.

Therapeutic benefit from traction, in the context intended herewith, means as ordinarily accepted that the amount of traction must be adequate to actually physically separate the intra-vertebral positions, which is therapeutic in the sense that it tends to relieve pressure on individual vertebra. However, traction can have more general beneficial effects on a patient when used in degrees less than that achieving such intra-vertebral separation. Such so-called "soft" traction (i.e. less than a "therapeutic" amount) may, for example, benefit a patient by psychologically immobilizing the patient achieve desired bed rest. A relatively light physical force is also provided in association with desired patient placement.

Another benefit of such soft traction is its potential to be achieved with less imposing machinery or mechanisms than heretofore used for extensive traction setups. Hence, particularly in a hospital setting, soft traction may be perceived by the patient as having greater aesthetic appeal, that is as being more user-friendly, further contributing to beneficial relaxation and bed rest for the patient. The cost of providing soft traction may also be significantly lower.

Yet another factor which may contribute to the degree of relaxation experienced by a patient, and the degree of comfort of the patient (particularly when concerning relatively extended periods of bed rest) is the relative dispersion of pressure between the patient and support surfaces thereof. In general, the greater the dispersion of pressure, the greater the degree of comfort for the patient, even to the point of reducing the incidence of decubitus ulcers, also known as bed sores.

Also, due to their cost and weight, conventional full-scale traction set-ups do not lend themselves to portability nor in-home use. Furthermore, unlimited use of conventional traction in the hands of a non-professional health care provider could prove injurious to the user.

SUMMARY OF THE INVENTION

The present invention recognizes and addresses various problems and drawbacks, such as those noted above and others, associated with providing traction for a user. Accordingly, it is one general object of the present invention to provide an improved apparatus and method for inducing traction for a patient or other user.

It is a more particular object of this invention to provide improved apparatus for inducing relatively soft amounts (i.e. less than a therapeutic amount) of traction in the cervical region of a user, generally for the immobilization of such user.

It is also an object of this invention to provide an improved apparatus and related method for inducing traction for a user, for use in combination with, or alternately with, more conventional traction apparatus. It is still another object of the present invention to provide such an improved apparatus which takes the form of a traction pillow. It is yet another more particular object of the invention to provide such a traction pillow which, when in use, provides a generally continuous support medium of resilient material for the head and neck of a user, for generally optimized dispersion of pressure to the user's head and neck. It is also a more particular object to provide such a traction pillow which is relatively inexpensive and highly portable, yet safe and effective for the induction and maintenance of relating soft traction (both in a hospital setting, or otherwise, such as a nursing home or private home).

It is yet another object of the present invention to provide a traction pillow which may be manipulated, generally in accordance with the presently disclosed method, after receipt of a user's head and neck thereon, for controllably and selectively establishing a degree of traction in the cervical region of such user. It is also an object to provide such a traction pillow which is effective in maintaining such degree of traction, but which is also safely and quickly disengaged from its traction function.

With further alternative features of the present invention, it is an object herewith to provide an integral, dual-size traction pillow which may be selectively reversed and used for patients having different head and neck morphology, i.e. relatively larger and smaller patients, respectively.

In addition to providing a user-friendly traction pillow, and which may be used by health care personnel, by others (with little or no basic training in providing health care) or even by the user himself, for inducing traction in the user, it is a general object to provide a traction pillow and related method of use therefor which tends to prevent obstruction of the user's breathing.

While various embodiments of the present invention may be provided, particularly through different combinations of features and characteristics further disclosed herein, several specific exemplary embodiments or constructions are disclosed herewith. One such exemplary embodiment of the present invention is directed to a traction pillow, comprising a generally integral body of resilient material having a substantially solid cervical roll portion situated generally along one side edge of the body; and a plurality of collapsible chambers defined within such body by walls which are directed generally away from the one side edge of the body, such chambers being situated generally outside of the cervical roll portion; whereby such cervical roll portion is adapted to be manipulated for rotation towards the chambers in conjunction with collapse of such chambers, generally in a direction away from the cervical roll portion, under the weight of a patient's head received on the pillow with the cervical region of such patient received across the roll portion, so that a degree of traction is induced outwardly along such patient's spine while a normal cervical curve of the patient is generally maintained.

Yet another exemplary construction in accordance with features of this invention concerns a pillow for supporting the head and neck of a user while controllably inducing a degree of traction in the cervical region of such user without disrupting normal cervical curvature of such user, such pillow comprising a resilient body of material defining two parallel lobes separated by a relative trough, one of such lobes being larger than the other and defining a substantially solid cervical roll adapted for receipt of a user's neck region thereacross with the head of such user supported generally in the trough; and at least one collapsible chamber means, defined in the body generally beneath the trough thereof, and situated adjacent and substantially parallel to the cervical roll, the chamber means including angled opposing wall members which are initially separated from one another but which are adapted for generally contacting one another by collapsing action of the chamber means whenever the head of a user is received on the trough with the user's neck received across the cervical roll, in conjunction with twisting of such cervical roll towards the chamber means, whereby an amount of traction is imparted to the cervical region of such user, while the normal cervical curvature thereof is maintained through curved support thereof across the cervical roll.

Various further aspects of the present invention both generally and particularly concern methodology of using a traction pillow incorporating structure and features as disclosed herewith. While such methodology of the present invention may take on various alternative formulations, one exemplary method of inducing a degree of traction in the cervical region of the user, whose head and neck are supported on a pillow, comprises the steps of providing a pillow of resilient material, such pillow including a head and neck upper support surface, and a substantially solid cervical roll situated along one side edge thereof and providing a generally raised lobe relative such support surface, and further including a plurality of chambers formed within the pillow by sidewalls which are angled away from the cervical roll; receiving a user's head and neck on the pillow with the head generally supported on the upper surface and the neck received across the cervical roll; and rotatably manipulating the cervical roll towards the chambers while the user's head and neck are received on the pillow, whereby such chambers are generally fully collapsed in a direction outward along the user's cervical region, so as to induce and maintain a degree of traction in such cervical region while maintaining the natural curvature of such region through curved support thereof across the raised lobe provided with the cervical roll.

Various modifications, substitution of equivalents, or reversals thereof to aspects, features and/or steps in accordance with this invention may be practiced by those of ordinary skill in the art. All such modifications and variations are intended to come within the spirit and scope of the present invention, which is discussed in greater detail throughout the remainder of the present specification.

BRIEF DESCRIPTION OF THE DRAWINGS

A full and enabling description of the present invention, including the best mode thereof, and concerning both the present apparatus and method, is more particularly set forth below, with reference to the accompanying figures, in which.

Figure 1:
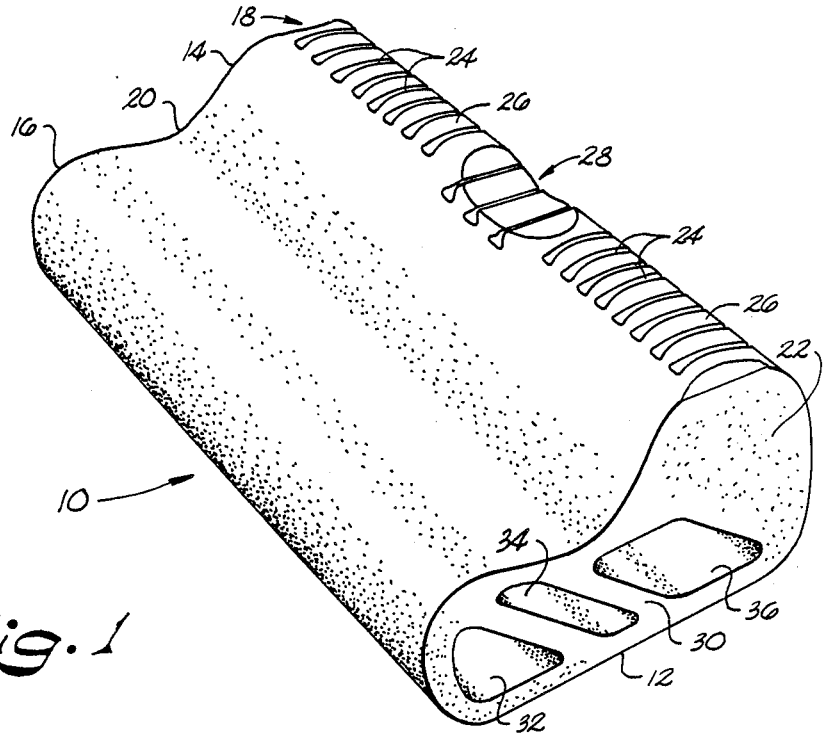
FIGS. 1–4 illustrate, respectively, an isometric, generally side view; an end elevation; a rear elevation; and a top elevation, of a first embodiment of a traction pillow in accordance with the present invention.

Repeat use of reference characters in the present specification and accompanying drawings is intended to indicate same or analogous features or elements of the subject invention.

DETAILED DESCRIPTION OF THE PREFERRED EMBODIMENTS

Figure 2:
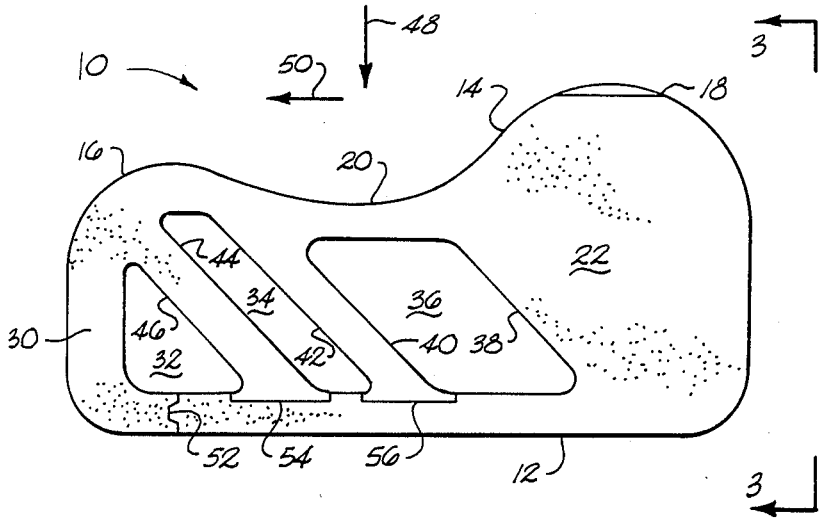
Figure 3:
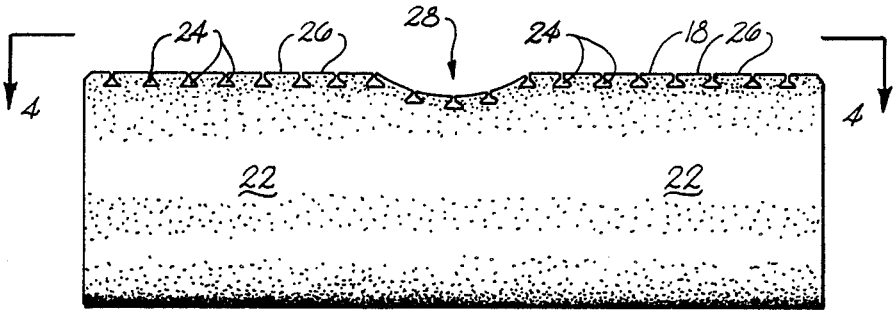
Figure 4:
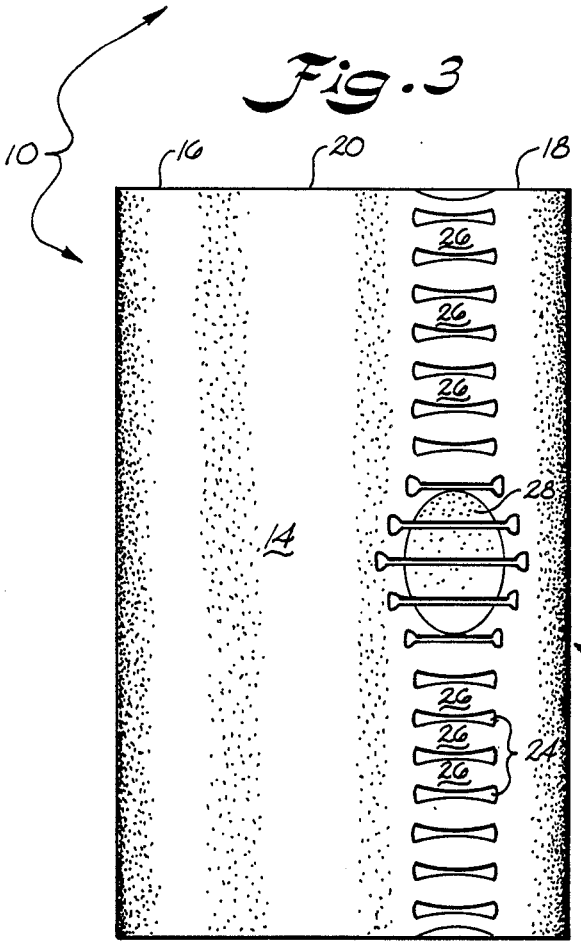

FIG. 1 illustrates a perspective view of a pillow 10, comprising resilient material such as polyurethane or functional equivalents thereof, forming a first embodiment of a traction pillow in accordance with the present invention. FIGS. 2–4 illustrate end, rear, and top elevational views, respectively, of traction pillow 10. As better shown in FIGS. 1 and 2, traction pillow 10, in this particular embodiment, has preferably a relatively flat lower surface 12 for resting on a patient support surface, such as a bed, mat, mattress pad, or the like. The traction pillow of such first embodiment is generally rectangular, and includes another surface, upper support surface 14, opposing its lower surface 12.

Upper support surface 14 has a predetermined profile, preferably including two relative lobes 16 and 18, of different sizes, and a relative trough 20 therebetween. The two lobes and the trough are generally parallel to one another, and extend laterally across the width of pillow 10.

As represented by FIGS. 1–3, lobe 18 is not only relatively larger than lobe 16, but it also comprises a substantially solid roll portion 22 which extends generally the lateral width of pillow 10. The upper surface of lobe 18 is curved, and particularly adapted for receipt of a user's neck there across for curved support of the user's neck or cervical region. Hence, substantially solid rolled portion 22 may be characterized as a cervical roll for curved support of a patient's neck thereacross, with the head of the user or patient resting primarily in trough 20, as further illustrated and discussed in greater detail with reference to present FIGS. 6 and 7, below. As also illustrated by FIGS. 1 and 2, cervical roll 22 preferably is integrally formed with the remainder of traction pillow 10, and comprises the same resilient material as used with such pillow.

As better illustrated by FIGS. 1, 3, and 4, the upper surface of cervical roll 22 is chopped, i.e. provided with a plurality of small channels 24. Such channels, which may be variously formed in the upper surface by cuts, bores, or the like made therethrough, are preferably situated parallel to one another and oriented so as to reside longitudinally with respect to a user's neck received thereacross. By "chopping" the upper surface of cervical roll 22, channels 24 define a plurality of separate support pads 26 therebetween, relative independent action of which enhances or optimizes dispersion of pressure on a user's neck received thereon. Also, the physical passageways created by channels 24 provide for increased circulation of air in and around a user's head and particularly the user's neck, for increased comfort of the user.

As further illustrated in such FIGS. 1, 3, and 4, a slight depression 28 may alternatively be formed in the upper surface of cervical roll 22, for providing orientation or registration of a user's neck therein, for centralling locating the user's head and neck on traction pillow 10. Further alternatively, no depression 28 or spaced channels 24 need be used with the upper surface of cervical roll 22, which may instead for some embodiments in accordance with the present invention be provided as a generally rounded, smooth surface as is illustrated with respect to the upper support surface of smaller lobe 16.

As illustrated by FIGS. 1, 2, and 4, upper support surface 14 is a generally continuous surface of resilient material, which defines the upper support surface of a generally continuous, resilient support medium, upon substantially full collapse of various chambers defined within traction pillow 10, such as chambers illustrated in FIGS. 1 and 2. In FIGS. 1–4, traction pillow 10 is illustrated in an unused, or unloaded, condition. In such condition, chamber means 30 are defined within the body of traction pillow 10, generally outside of the cervical roll portion 22 thereof. Such chamber means includes at least one chamber therein, defined by angled side walls which are directed away from cervical roll 22.

While in general variation in the number and particular cross-sectional characteristics of given chambers may be practiced, the exemplary embodiment of FIGS. 1 and 2 makes use of three such chambers 32, 34, and 36. As illustrated in such two figures, each of the interiorly defined chambers are formed by angled side walls, such as 38–46. Due to the direction in which such side walls are defined relative the remaining construction of traction pillow 10, weight received downwardly on traction pillow 10 in the direction of force arrow 48 is, at least in part, translated into rearward motion in the direction of force arrow 50 by the collapse of chamber means 30 (see FIG. 2). FIG. 2 illustrates the uncollapsed condition of chamber means 30, while subsequent figures, including FIGS. 5–7 and their related discussion are concerned with various stages of collapse of chamber means 30.

Further with reference to present FIG. 2, it should be noted that sub-chambers 32, 34, and 36, as illustrated in such exemplary embodiment, generally comprise chambers or channels formed in parallel across the full lateral width of the traction pillow 10. Such channels may be formed by various methods of drilling and cutting the resilient material comprising traction pillow 10. As represented by FIG. 1, such channels have been drilled out of the resilient material, such as polyurethane or other foam products. As represented by FIG. 2, and the cut lines 52, 54, and 56 illustrated therein, a single lateral blade may alternatively be variously positioned and directed throughout the body of traction pillow 10 for removal of material therefrom to define the walls 38–46, and thereby form channels 32, 34, and 36.

Further in the alternative, chamber means 30 may be delineated by relatively softer material than that which the remainder of traction pillow 10 is formed, instead of comprising the air-filled chambers illustrated in this exemplary embodiment. Even further in the alternative, various other constructions may be provided for defining chamber means having angled opposing wall members initially separated from one another, but which are adapted for generally contacting one another by collapsing action of said chamber means whenever a user places his or her head and neck on the traction pillow, and/or in conjunction with manipulation of a cervical roll feature of this invention, as more fully discussed below with reference to FIGS. 5–7.

Figure 5:
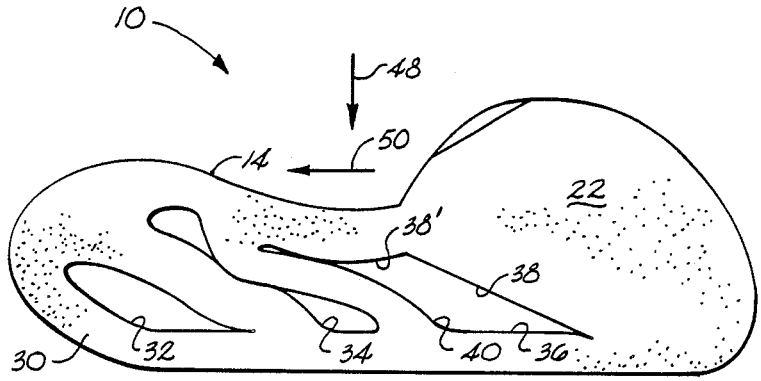
FIG. 5 illustrates an end elevation of the first embodiment, as in present FIG. 2, with collapsible chambers of the traction pillow partially collapsed.

For more particular explanation of such collapsing function of traction pillow 10, FIG. 5 illustrates an end elevational view of a traction pillow 10, such as in present FIG. 2. In FIG. 5, pillow 10 is illustrated as at least partially loaded, i.e. the pillow is illustrated generally in a configuration which it typically assumes whenever the head and neck of a user is received thereon. Such weight (in this instance not illustrated, but again represented by force arrow 48) results in at least partial collapse of chamber means 30, so that opposing angled walls defining sub-chambers thereof are brought closer together. For example, opposing walls 38 and 40 (particularly including the upper portion of 38 illustrated as 38', are brought closer together. Such function of chamber means 30 is in part accomplished through the angled cross-sectional shape of the sub-chambers, wherein in FIG. 2 sub-chambers 34 and 36 thereof are particularly illustrated as being of generally parallelogram-shaped cross-section. The present invention is not limited to such cross-sectional shapes. For example, see generally triangularly-shaped sub-chamber 32 of present FIG. 2.

Collapse of any one of sub-chambers 32, 34, 36 contributes to displacement of upper support surface 14 in the direction of force arrow 50, as discussed above in connection with present FIG. 2. The amount of movement of upper support surface 14 in the direction of arrow 50, compared with its unloaded condition (FIG. 2) is generally referred to as the amount of distraction achieved with the traction pillow 10. With the present embodiment, such distraction can be up to as much as $2\frac{1}{2}$ inches, whenever the chamber means thereof are fully collapsed and the cervical roll portion 22 has been fully rotated, as discussed further hereinbelow with reference to FIG. 7.

Figure 6:
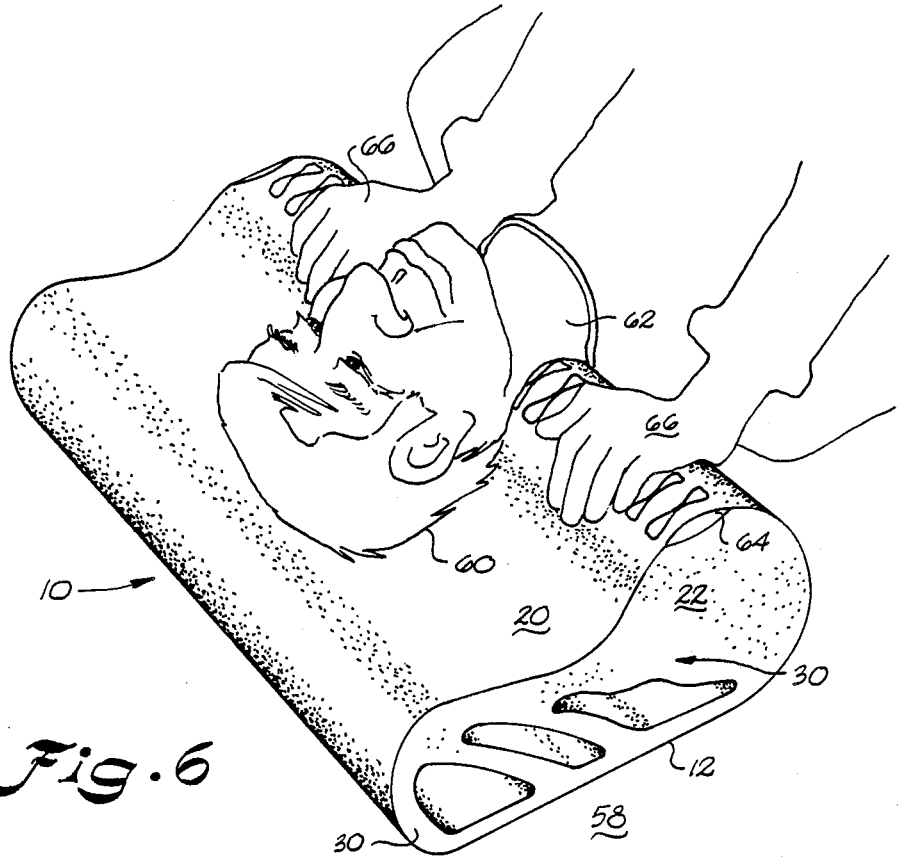
FIG. 6 illustrates a perspective view of a traction pillow as in FIG. 1, with the head and neck of a user supported thereon, in accordance with the present invention.
Figure 7:
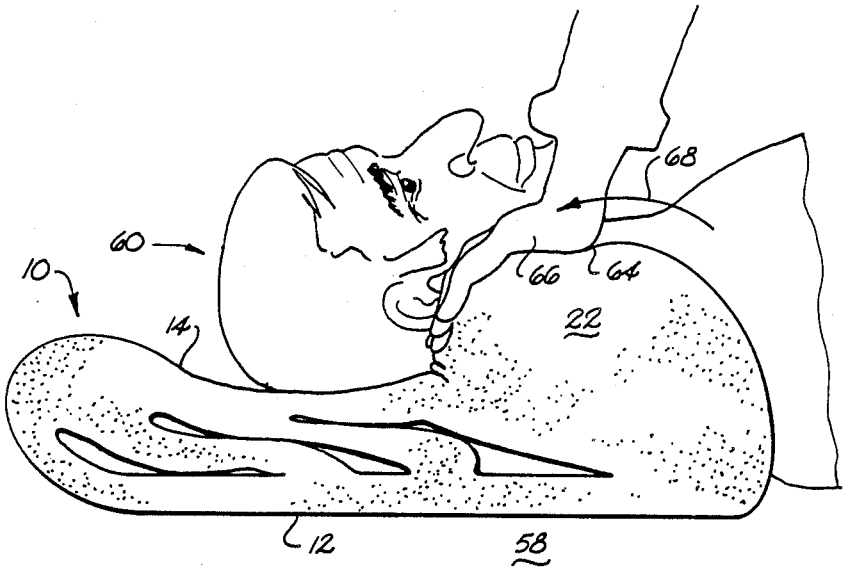
FIG. 7 illustrates an end elevational view of a traction pillow as in present FIGS. 2 and 5, associated with a user as in present FIG. 6, and with collapsible chambers thereof generally fully collapsed as an exemplary cervical roll portion of the pillow is rotatably manipulated.

Present FIGS. 6 and 7 more fully illustrate preferred methodology in accordance with the present invention for using a traction pillow of the construction herein illustrated. In particular, it is preferred that the lower support surface 12 of a pillow 10 be placed on a patient support surface 58, such as a bed, mattress pad, or the like. With pillow 10 placed particularly towards one end of such bed, and with cervical roll 22 positioned closer to the center of such bed then the other lobe of the pillow, a patient in a supine position may be supported with his or her head 60 received generally in trough 20, and with the patient's neck 62 received across the upper curved surface 64 of cervical roll 22. Initial receipt of the user's head and neck typically results in an amount of partial collapse of the sub-chambers of chamber means 30, such as illustrated both in FIGS. 5 and 6. The amount of such initial, partial collapse is in part determined by an equilibrium reached between the resiliency of the material comprising pillow 10, and the weight of the user's head and neck thereon. Obviously, at least some amount of distraction occurs upon such partial collapse of chamber means 30, which results in at least partial rotation of cervical roll 22 towards chamber means 30, all as illustrated in present FIG. 5. However, a further feature of the present invention alternatively permits even more effective, i.e. positive, setting and maintenance of the amount of distraction or traction established in the cervical region or neck of the user.

Such further feature is represented by FIG. 7, wherein the hands 66 of a health care provider may be used to rotatably manipulate cervical roll 22, preferably by twisting or rotating same backwards in the direction of arrow 68, generally so as to fully collapse the sub-chambers of chamber means 30. As illustrated in FIG. 7, such relatively full collapse causes the side walls of various sub-chambers to come into generally direct mutual contact. The resulting pillow configuration obtained between lower surface 12 and upper support surface 14 is a generally continuous support medium of resilient material, providing optimized resilient support of a patient's head and neck thereon.

While the FIG. 7 positioning of a patient relative traction pillow 10 provides improved traction and resilient support of the user thereon, rotation of cervical roll 22 in the direction of arrow 68 constitutes a further, alternative step in accordance with the present invention, which invention need not be strictly limited to inclusion of such actual step since beneficial soft traction to a degree is otherwise achieved with the present invention, as described hereinabove.

Inclusion of the rotatable manipulation step (represented by FIG. 7) provides another, generally non-traction, benefit in that the chin of user 60 tends to be deflected upward, which tends to prevent obstruction of the user's breathing passage. Also, such positive rotation step generally adds to the initial amount of distraction achieved by the use represented by FIGS. 5 and 6, thereby controlling the amount of traction established with use of traction pillow 10 and practice of the present invention. In fact, the amount of twisting imparted to cervical roll 22 directly relates, to a degree, to the amount of traction induced in the cervical region of a patient, which cervical region traction maintains the normal or natural cervical curvature of the patient by curved support thereon across the upper curved surface 64 of cervical roll 22.

Another advantage with inclusion of the optional step of rotatable manipulation represented by present FIG. 7 is that any type of hammock-type support is generally prevented, so that full resilient disbursement of pressure is achieved with a generally continuous foam medium below the head and neck of the user. In other words, partial collapse of chamber means 30 leaves portions of upper support surface 14 suspended over regions of sub-chambers where no resilient material may be found (at least in the illustrated embodiment), thus resulting in the hammocking effect mentioned above. The twisting manipulation of cervical roll 22 completes collapse of chamber means 30, so that full benefit of a continuous resilient medium is obtained. As alluded to above, other embodiments of this invention may utilize alternatives to the air-filled sub-chambers, thus alternatively contributing to avoidance of such hammocking effect.

The present invention may be practiced in combination with use of a chin halter or similar device otherwise known to conventional traction techniques. However, since the weight of an average head, typically 10–13 pounds, is used by the present invention to translate downward force 48 at least partially into "rearward" force 50, reasonable amounts of "soft" traction may be achieved or established through practice of the present invention alone. Equivalent directly applied weight of conventional type traction in the area of 6 pounds or less does not result in "therapeutic" effects, where the neck is adequately pulled to separate intra-vertebral spaces. With the present invention alone, similar amounts of "soft" traction may be achieved.

Maintenance of the established traction is also achieved with the present invention, by virtue of the co-efficient of friction of material comprising traction pillow 10, such as polyurethane. For example, the co-efficient of friction between lower surface 12 of pillow 10 and patient support surface 58 is adequate to prevent migration of the pillow once traction is established. Furthermore, particularly with reference to present FIG. 7, once cervical roll 22 is manipulated by rotating same in the direction of chamber means 30, the resiliency of traction pillow 10 is not alone adequate to again restore chamber means 30 to either its partially collapsed or non-collapsed positions. Hence, the overall configuration and function of traction pillow 10, combined with the co-efficient of friction thereof, maintains established traction, while also maintaining natural cervical curvature of the patient as discussed above.

Figure 8:
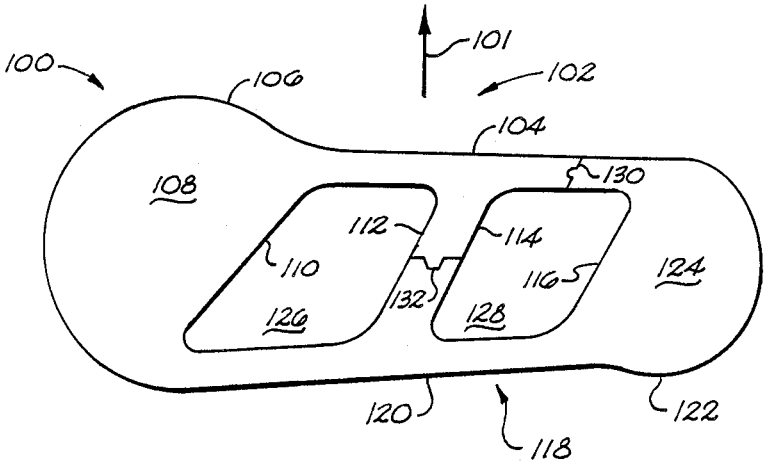
FIG. 8 illustrates an end elevational view of an alternative embodiment of a traction pillow in accordance with the present invention, more particularly concerning an integral, dual-size traction pillow for reversibility.

It is preferred that traction pillows of different sizes, i.e. different relative lobes and troughs, be provided for individuals with different head and neck morphology. In general, it is also noted that adult female anatomy generally dictates smaller size traction pillow measurements than appropriate for an adult male, even though females may appear to have slightly longer necks. The exemplary construction of present FIG. 8 illustrates a second embodiment of a traction pillow 100 (in elevational view), which comprises an integral, dual-size pillow in accordance with the present invention for reversibly accommodating patients of different head and neck morphology.

Each side of pillow 100 has its own generally flat support surface and matching relative lobe. Also, in each instance, the relative lobe is situated on a side edge of the pillow away from the direction in which angled side walls of chamber means 30 are positioned, whenever such side edged is turned for facing upward, i.e. in the direction of arrow 101. For example, side 102 has an upper support surface 104 and relatively larger cervical roll 106, which again has a generally solid roll portion 108 essentially free of chambers therein. When situated in the position illustrated in FIG. 8, with surface 104 directed upward in the direction of arrow 101, angled side walls 110–116 are directed generally away from roll 108, so as to function in precisely the same manner as described above with reference to FIGS. 1–7.

Similarly, whenever pillow 100 is reversed so that side 118 thereof is directed upward, a support surface 120 has a generally smaller relative lobe 122, which again has a generally solid cervical roll portion 124 therebeneath, also without any chamber means in such portion. Since the pillow is reversed, the same opposing, angled side walls 110–116 are again directed away from the side edge of the pillow having relative lobe 122 thereof. Hence, the same function as described above with reference to FIGS. 1–7 is again achieved, with a basically different size pillow configuration for use with different sized individuals.

Chambers 126 and 128 may again be of various cross-section configurations, though a generally parallelogram-shaped cross-section is preferred. Such chambers may also be variously formed in pillow 100, with cuts made by a single continuous blade, passing for example through cut marks 130 and 132 comprising one method of continuously forming the integral, dual-size traction pillow 100. Pillow 100 also preferably comprises resilient material such as polyurethane as is the case with traction pillow 10.

As evident from the foregoing, a relatively inexpensive apparatus in the form of a traction pillow may be provided for achieving soft traction for a user or a patient in either a home or a hospital setting, and may be optionally practiced together with, or in alternating time periods with, conventional types of traction. The traction pillow is safe and effective for use, and permits rapid disengagement of such traction by reversal of the cervical roll rotation step illustrated in present FIG. 7 (which serves to only partially relieve traction established thereby), or even more simply by raising the user's head from either pillow 10 or pillow 100.

Particular embodiments in accordance with the present invention have been illustrated in detail, such embodiments having particular chamber means cross-sectional configurations of such geometric design that friction is prevented between adjacent members which might otherwise "hang-up" the pillow to prevent it from properly collapsing. However, various alternative configurations of either the chamber means, or other features or steps of the present invention may be practiced by those of ordinary skill in the art. All such modifications and variations are intended to come within the spirit and scope of the present invention, which is more particularly defined by the appended claims.

What is claimed is:

1. A traction pillow, comprising:

a generally integral body of resilient material having a substantially solid cervical roll means situated generally along one side edge of said body; and a plurality of collapsible chamber means defined within said body by angled, opposing walls which are directed generally towards another side edge of said body which is situated opposite said one side edge thereof, said chamber means being situated generally outside of said cervical roll means;

wherein said cervical roll means and said chamber means functionally respond to receipt of a patient's head on said pillow with the cervical region of such patient received across said cervical roll means, in conjunction with manipulation of said cervical roll means for rotation towards said chamber means, for collapsing said chamber means, generally in a direction away from said cervical roll means, so that said opposing walls contact one another for substantially continuous resilient support of a patient's head, and further for inducing a degree of traction outwardly along such patient's spine while generally maintaining a normal cervical curve of the patient.

2. A traction pillow as in claim 1, wherein said cervical roll means includes an upper support surface with a plurality of channels defined therein situated generally in alignment between said one and said another body side edges, said channels dispersing pressure on such neck and providing increased circulation of air therearound.

3. A traction pillow as in claim 1, wherein said cervical roll means includes an upper support surface with a curved depression defined therein, said depression being adapted for receipt of a patient's neck, so that predetermined placement of a patient's neck and head on said traction pillow may be obtained.

4. A traction pillow as in claim 1, wherein said cervical roll means and said chamber means are operative for producing relatively soft traction for purposes of tending to immobilize a patient, without producing a therapeutic action of stretching the patient's spine an amount adequate to separate intra-vertebral spaces therein.

5. A traction pillow as in claim 2, wherein said resilient material comprises polyurethane foam, which has a coefficient of friction adequate to permit distraction of a patient's head and neck received thereon without the pillow slipping relative a surface on which the pillow is supported.

6. A traction pillow as in claim 1, wherein said cervical roll means is operative during rotation thereof towards said chamber means for lifting the chin of a patient whose neck is received across said roll means, whereby forward flexure of the patient's head is prevented, which forward flexure could otherwise cause obstructed breathing of the patient.

7. A traction pillow as in claim 1, wherein said plurality of collapsible chamber means comprise at least two chambers of a generally parallelogram-shaped cross-section, when not collapsed, with a common angled wall therebetween, said cross-sections of said chambers being substantially constant across the lateral width of said traction pillow so that collapse of said chambers results in folding of said parallelogram-shaped cross-sections along the long axis of such shapes.

8. A traction pillow as in claim 1, further comprising a second substantially solid cervical roll means situated essentially along said another side edge of said body opposite said one side edge thereof, said two cervical roll means having prominent lobe aspects which project to different degrees on opposite sides of said traction pillow, whereby said traction pillow may be reversed for collapsible operation with selected of said cervical roll means received under the neck of a patient, thus providing a dual-size, reversible pillow in a single, unitary construction.

9. A pillow for supporting the head and neck of a user while controllably inducing a degree of traction in the cervical region of such user without disrupting normal cervical curvature of such user, said pillow comprising:

a resilient body of material defining two parallel lobes separated by a relative trough, one of said lobes being larger than the other and defining a substantially solid cervical roll means for receipt of a user's neck region thereacross with the head of such user supported generally in said trough; and at least one collapsible chamber means, defined in said body generally beneath said trough thereof, and situated adjacent and substantially parallel to said cervical roll means, said chamber means including angled opposing wall members which are initially separated from one another but which generally contact one another by collapsing action of said chamber means responsive to receipt of the head of a user on said trough with the user's neck received across said cervical roll means, in conjunction with twisting of said cervical roll means towards said chamber means, for imparting an amount of traction to the cervical region of such user, while the normal cervical curvature thereof is maintained through curved support thereof across said cervical roll means, and for providing generally continuous resilient support of the user's head.

10. A pillow as in claim 9, wherein said chamber means includes a plurality of sub-chambers, each of which are defined by parallel, angled wall members situated across the lateral width of said pillow, all such sub-chambers collapsing upon receipt of a user's head and neck on said pillow so that said opposing walls thereof come into mutual contact for optimized dispersion of pressure on the user with said resilient body material, whereby upper support walls of said sub-chambers are generally continuously supported with resilient material.

11. A pillow as in claim 9, wherein said cervical roll means and said chamber means impart an amount of traction equivalent to less than 10 pounds of force acting outwardly along the user's cervical region.

12. A pillow as in claim 9, wherein the surface of the cervical roll means generally frictionally engages a user's head and neck to the extent same contacts said roll means, so that twisting of said cervical roll means towards said chamber means is operative to lift the user's chin upward to prevent obstruction of the user's breathing.

13. A pillow as in claim 9, wherein said relatively larger lobe projects outwardly on one side of said pillow, and the other lobe projects outwardly on an opposite side of said pillow, whereby said pillow may be reversed for use with different size users, with a selected one of said two lobes serving as a cervical roll means for receipt of a user's neck thereacross.

14. A method of inducing a degree of traction in the cervical region of a user whose head and neck are supported on a pillow, comprising the steps of:

providing a pillow of resilient material, said pillow including a head and neck upper support surface, a substantially solid cervical roll situated along one side edge of said pillow and defining a generally raised lobe relative said support surface, and further including a plurality of chambers formed within said pillow by opposing side-walls which are angled away from said cervical roll;

receiving a user's head and neck on said pillow with the head generally supported on said upper surface and the neck received across said cervical roll; and rotatably manipulating said cervical roll towards said chambers while the user's head and neck are received on said pillow, until said chambers are generally collapsed in a direction outward along the user's cervical region such that opposing forming side-walls thereof are brought into contact to define generally continuous resilient material, which induces and maintains a degree of traction in such cervical region while maintaining the natural curvature of such region through curved support thereof across said raised lobe provided with said cervical roll.

15. A method as in claim 14, wherein:

said providing step includes using polyurethane for said resilient material, said polyurethane having a coefficient of friction adequate for engaging a user support surface generally without slippage after said cervical roll rotation step is performed, whereby said induced degree of traction is maintained.

16. A method as in claim 14, wherein:

said providing step further includes providing a second support surface on an opposite side of said pillow from said upper support surface thereof, and providing a second cervical roll on a side edge of said pillow opposite from said one edge thereof, said second cervical roll forming a second raised lobe projecting from said second support surface to a degree less than said generally raised lobe projects relative said upper support surface; and wherein said method further comprises the step of selecting one or the other of said support surfaces for receiving the head and neck of the user with the appropriate size lobe supporting the cervical region of said user, whereby a reversible, dual-sized pillow may be provided in a single, unitary construction for inducing a degree of traction with users having different sized head and neck morphology.

17. A method as in claim 14, wherein said rotatable manipulation step further tends to at least slightly lift the chin of the user, whereby obstruction of the user's breathing is prevented.

18. A method of establishing and maintaining relatively low amounts of traction in the cervical region of a patient, comprising the steps of:

providing a patient support surface, such as a bed;

providing a traction pillow, comprising a generally rectangular construction of resilient foamed material, having a generally flat lower surface for receipt on the patient support surface, and a profiled upper surface including two relative lobes of different sizes on opposing side edges of said pillow and a relative trough therebetween, said lobes and said trough extending parallel to one another across the lateral width of said pillow, said pillow further defining internal chambers having angled walls directed for collapse of said chambers away from the larger of said lobes;

placing said traction pillow on said patient support surface relatively adjacent an end of said patient support surface, and with said profiled upper surface of said pillow facing upward, and with said larger lobe thereof placed nearer the center of said patient support surface than the smaller of said lobes;

situating a patient on said patient support surface in a generally supine position, and with the patient's head and neck supported on said traction pillow, the patient's neck in particular being received across said larger lobe, with such patient placement on said pillow tending to at least partially collapse said pillow chambers so as to pull outwardly along the patient's cervical region; and thereafter rotatably manipulating said larger lobe by twisting same towards said pillow chambers, so as to more fully collapse same, and so as to more positively establish a degree of traction in the patient's cervical region, whereby the curvature of said larger lobe supporting the patient's neck maintains natural cervical curvature of the patient, while friction between said pillow lower surface and said patient support surface maintains traction established with said pillow and said situating and twisting steps.

* * * * *